US005111607A

United States Patent [19]

Blaser

[11] Patent Number: 5,111,607

[45] Date of Patent: May 12, 1992

[54] RESETTABLE BREECHBLOCK WEDGES IN A BREAK-OPEN FIREARM WITH TOP LEVER BREECHBLOCK

[75] Inventor: Horst Blaser, Isny im Allgäu, Fed. Rep. of Germany

[73] Assignee: Dynamit Nobel AG, Troisdorf, Fed. Rep. of Germany

[21] Appl. No.: 640,865

[22] Filed: Jan. 14, 1991

[30] Foreign Application Priority Data

Jan. 13, 1990 [DE] Fed. Rep. of Germany ..... 4000817

[51] Int. Cl.[5] ..... F41A 3/58
[52] U.S. Cl. ..... 42/44
[58] Field of Search ..... 42/44

[56] References Cited

U.S. PATENT DOCUMENTS 514,574 2/1894 Tonks ..... 42/44
3,530,609 9/1970 Staggs ..... 42/43
4,964,232 10/1990 Mainland et al. ..... 42/44

FOREIGN PATENT DOCUMENTS 0247578 6/1926 United Kingdom ..... 42/44

*Primary Examiner*—Michael J. Carone
*Attorney, Agent, or Firm*—Antonelli, Terry, Stout & Kraus

[57] ABSTRACT

The fixation of the barrel housing to the breech housing in a break-open gun is controlled by a top lever breechblock, the bottom of which carries, in a groove, countersunk, a connecting member with an eccentric tenon in a displaceable fashion, the tenon being insertable in one of two bores in a control part, and the control part driving the breechblock wedge or wedges, wherein at least one spring between the control part and the breechblock wedge absorbs, when the control wedge is not worn, a distance increment so that the breechblock lever during locking can always go back into a central position. The gun can readily be refitted from a right-hand shooter to a left-hand shooter: the connecting member is rotated by 180° and inserted in the opposite bore, the spring stop is likewise turned, and the breech spring is exchanged with the pressure bolt and the stop bolt.

8 Claims, 2 Drawing Sheets

RESETTABLE BREECHBLOCK WEDGES IN A BREAK-OPEN FIREARM WITH TOP LEVER BREECHBLOCK

BACKGROUND OF THE INVENTION

This invention relates to a break-open firearm with at least one breechblock wedge movably guided in the barrel direction, wherein the breechblock wedge is driven by a control part or element, at least one force-transmitting compression spring being arranged between the breechblock wedge and the control part, wherein the compression spring permits absorption of a distance in case the breechblock wedge is no longer movable but the control part, for attainment of a desired position of a lever, is moved still further.

In hunting and sport firearms with barrels having a break-open action, a fully mechanized manufacture is impossible because the required dimensional accuracy in the interplay of barrel and breech casing cannot be achieved. Therefore, a so-called selective assembly is utilized, i.e., structural parts are inserted as described, for example, in DE 3,426,229 A1 for adapter plates of a U-shaped configuration.

The barrels, housed in a barrel housing, are affixed to the breechblock housing by at least one spring-loaded locking wedge or bolt, movable in the barrel direction; this wedge or bolt engages from the breechblock housing into a barrel hook mounted to the barrel housing. Such breechblock wedges are disclosed, for example, in German Patent 805,992 or U.S. Pat. No. 3,530,609.

Owing to the great stress on the firearm and the concomitant wear and tear, the breechblock wedge is permitted to enter an increasing distance farther underneath the barrel hook. However, since the breechblock is connected also to safety devices and an automatic pivoting of the breechblock to a central position of the breechblock lever, required by the shooter, is impossible if the breechblock wedge must thereby be moved by varying distances, the proposal has been advanced in U.S. Pat. No. 3,530,609 to uncouple the breechblock lever and the breechblock wedge mechanically by the interposition of a control part in such a way that the breechblock lever can always be moved into a desired position, and a differently far movement in case of new and worn wedges can be absorbed by a compression spring. The breechblock lever transmits its motion to a control part which transfers the movement of the control part to the breechblock wedge by interposed compression springs, rather than directly. Once the breechblock wedge has locked in place underneath the barrel hook and thus cannot move any farther, merely the distance between the control part and the breechblock wedge is reduced in this arrangement until the desired position of a lever has been achieved, and there is no mechanical overstress at the breech or at the breechblock wedge.

The clamping and locking device with a clamping lever underneath the triggers in the firearm according to U.S. Pat. No. 3,530,609 has not been well received by most shooters.

SUMMARY OF THE INVENTION

It is an object of the invention to provide a break-open firearm with at least one automatically resetting breechblock wedge in conjunction with a breechblock lever mounted rotatably at the top to the breechblock casing.

This object has been attained by a break-open firearm of the type heretofore described by providing that the movement of the control part takes place by way of a breechblock lever shaft arranged perpendicularly to the barrel direction, that the transmission of the movement from the breechblock lever shaft to the control part takes place via a connecting member with a tenon on one side of the connecting member, that the connecting member can be inserted in a groove on the underside of the breechblock lever shaft, that two bores are provided in the control part adapted to the tenon at the connecting member and arranged in the control part so that, depending on the insertion of the connecting member in the underside of the breechblock lever shaft, a movement of the breechblock lever shaft in the clockwise direction or, if desired, in the counterclockwise direction (i.e., for a right-handed or left-handed shooter) leads in each case to the desired opening movement of the breechblock wedge.

This firearm has the advantage that the breechblock lever, no matter how new or worn the breechblock wedge, will always lead to the central position (normal position) of the breechblock lever, which is required by the shooter for optical reasons alone and which, in most cases, is also furthermore necessary for the reason that only in such a central position will it be possible for additional safety devices at the firearm to become effective.

Another great advantage resides in that the same firearm can be utilized by right-handed shooters and left-handed shooters, because the required adaptations can be brought about in a very simple way. By reinsertion of the tenon of the connecting member, guided in a groove in the breechblock lever shaft, into the other bore in the control member, the direction of rotation of the breechblock lever during opening and, respectively, closing is reversed.

In order to attain the central position of the breechblock lever shaft "automatically", the restoring force of a corresponding "breech spring" exerted on the breechblock lever must be markedly greater than the inhibiting effect by a restricted breechblock wedge movement.

During the resetting step, it must furthermore be considered that also the restoring force exerted on the breechblock lever must be reversed in case of right-handed versus left-handed shooters. According to this invention, the restoring spring is likewise reversed for this purpose. For example, in a simple way a restoring spring guided in a bore transversely to the breechblock lever is transposed, and a spring abutment is rotated by 180°. The bore passes through the entire breech housing and is equipped with a thread at the two outlets. The breechblock lever shaft has a mounting bore at the level of the spring bore, this mounting bore being located at an angle of 90° with respect to the spring bore. A spring stop threaded in place from the opposite side is arranged in this bore; this spring stop can likewise be turned toward the left or right. The pressure member stressed by the compression spring is urged against this spring stop. A headless screw is the end of this arrangement, this screw bringing the spring to the required pretensioning. A pressure bolt is disposed in opposition to this arrangement, this bolt serving as abutment for the spring stop and being controllable by means of a headless screw so that the breechblock and/or the breechblock lever can be adjusted exactly into the central position. When changing from right to left, the spring bearing is rotated by 180°, and the spring and the pressure bolt are exchanged against each other.

With regard to the shape of the bore at the control part for accommodating the tenon of the connecting member, it is to be noted that the control part executes a linear displacement whereas the tenon makes a redial movement.

BRIEF DESCRIPTION OF THE DRAWINGS

The invention is illustrated in the accompanying drawings by way of example and will be described in greater detail below. In the drawings.

DETAILED DESCRIPTION OF THE DRAWINGS

Figure 2:
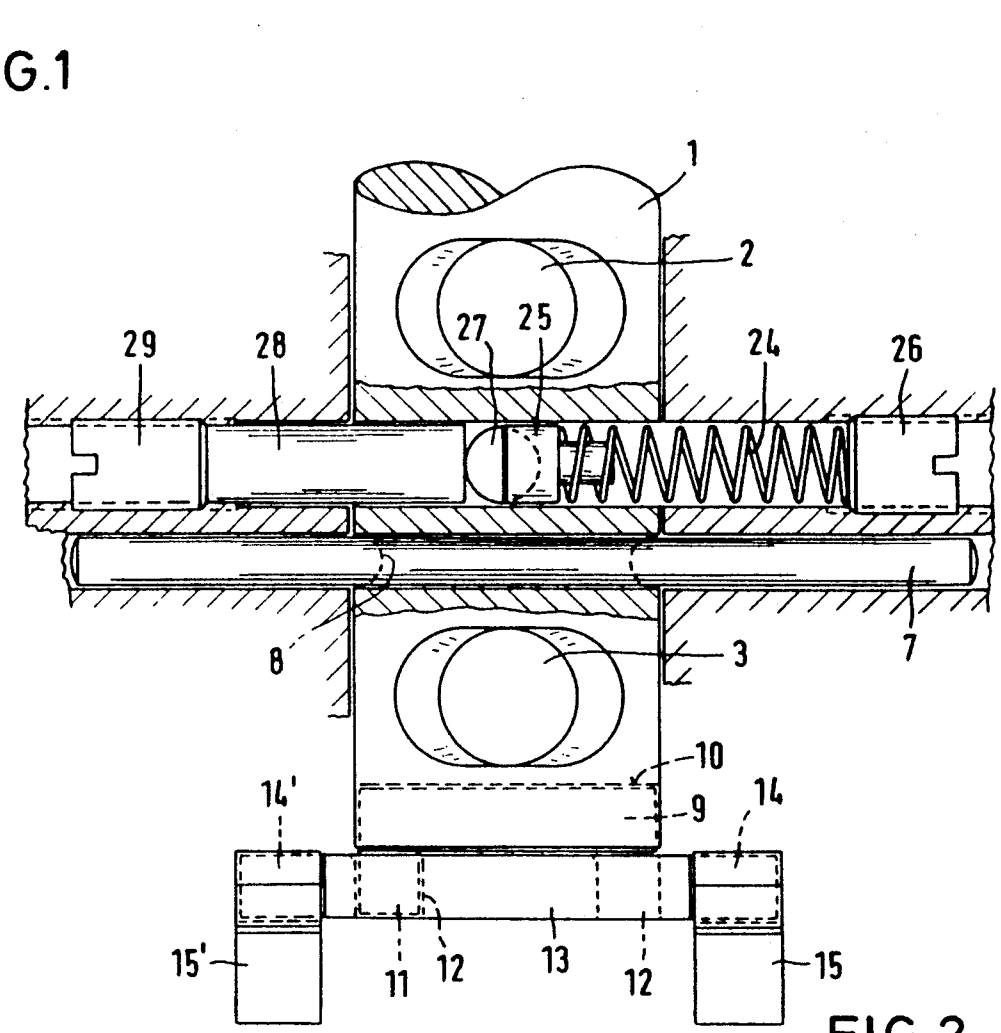
FIG. 2 shows part of the breechblock casing in a section taken in the plane of the breechblock lever shaft perpendicularly to the barrel direction.
Figure 1:
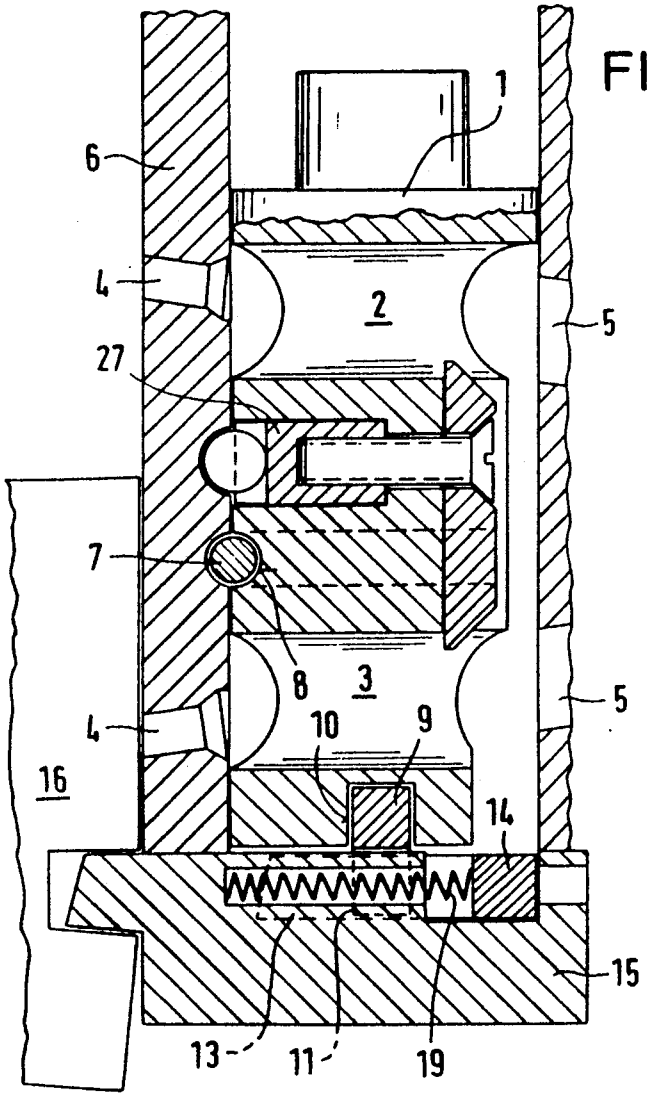
FIG. 1 shows part of the breechblock casing in a section taken in the plane of the breechblock lever shaft in the barrel direction.

The embodiment illustrated in the drawings relates to a gun with two superimposed barrels. The breechblock lever shaft 1, arranged perpendicularly to the barrels, comprises two cavities 2, 3 in order to arrange, in the central plane of the gun, also the firing pins (not shown) which are axially movable in guide means 4, 5 in the breech casing 6 and are driven by strikers in the lock which, in FIG. 1, would follow toward the right-hand side. The movement of the firing pins and of the strikers is thus almost, unidirectional meaning the smallest possible springs and thus also a minimum of tensioning work. The guidance of the rotatable breechblock lever shaft 1 is determined by a stud 7 in conjunction with an annular groove 8 at the breechblock lever shaft 1 and the breechblock housing 6.

Translation of the rotational movement of the breechblock lever shaft 1 into a longitudinal movement takes place by way of a rectangular, elongated connecting member 9 guided in an axially displaceable fashion in a groove 10 in the bottom of the breechblock lever shaft 1. A tenon 11 is arranged eccentrically on the underside of the connecting member 9; this tenon engages in a bore 12, 12' in a control part 13. On both sides of the control part 13, driving tangs 14, 14' are disposed. The control part 13 acts on a bipartite breechblock wedge 15, 15'. The breech wedges 15, 15' take care of a precise connection of the breech casing 6 with the barrel hook 16.

Figure 3:
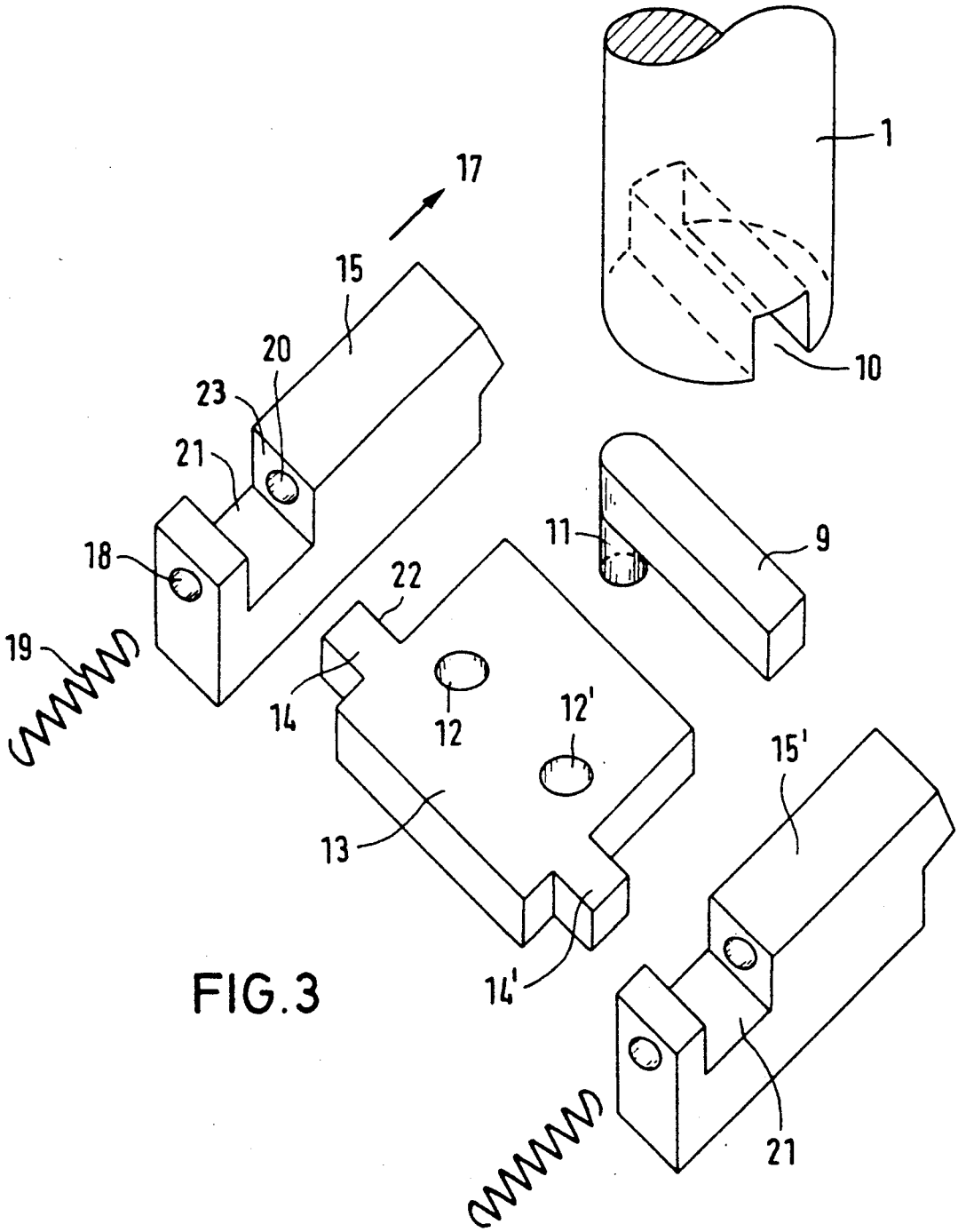
FIG. 3 is a perspective view of the interplay of breechblock lever shaft, connecting member, control part, and breechblock wedge.

The mechanism of distance transmission from the control part 13 to the breechblock wedges 15, 15' is advantageous. As shown in FIG. 3, through a bore 18, a spring 19 can be inserted in a blind hole 20 in the breechblock wedge 15, 15'. The driving tang 14 fits into a recess 21 in the breech wedge 15, but the width of the recess 21 is larger than the breadth of the driving tang 14. On account of the compressed spring 19 inserted in the bore 20, clearance exists between the "driving" surface 22 at the control part 13 and the "driven" surface 23 at the breechblock wedge 15; upon a movement in direction 17, this clearance remains preserved unchanged as long as no resistance becomes effective from the wedge. On account of the clearance bridged by the spring 19, however, the control part 13 can still be moved and, respectively, turning of the breechblock lever shaft 1 can be continued even when the control wedge 15 can no longer move. On account of such a distance absorption, wear on the breechblock wedge can be compensated for since, in the initial condition, the control part and the breechblock wedge are adapted to each other in such a way that up to one-third of the distance is absorbed by the spring between the control part and the breechblock wedge. Even if the two breechblock wedges 15, 15' should have experienced nonuniform wear and tear, this mechanism will in each case push them fully underneath the barrel hook 16.

For opening the breech, the breechblock lever shaft is rotated by about 30° from the central position of the breechblock lever. Pivoting into the central position takes place automatically by a pressure bolt 25 acted upon by a locking spring 24 guided in the housing. The pretensioning of the spring 24 is adjusted by a headless screw 26. By means of the screw, the pressure on a spring abutment 27 is set, this abutment resting against a bolt 28 and being adjustable by means of a setscrew 29. Upon opening of the breech, the spring 24 is tensioned. The breechblock lever is maintained in its open position by means of a locking pawl (not illustrated). During closing, the locking pawl is triggered by the underside of the barrel end and releases the breechblock pretensioned by the spring. The two breechblock wedges 15, 15', driven by the springs 19, enter with their wedge-shaped surface areas into grooves at the barrel hook 16 on the barrel end. The force of the two springs 19; the final position (central position of the breechblock lever) is thereby attained in every case.

When changing the breech from the right to the left, the spring stop 27 is rotated by 180°, in addition to turning the connecting member 9, i.e., the spring 24 with the pressure bolt 25 is exchanged against the stop bolt 28.

What is claimed is:

1. A break-open firearm having at least one breechblock wedge movably guided in a barrel direction wherein the breechblock wedge is driven by a control part, at least one force-transmitting compression spring arranged between the breechblock wedge and the control part for permitting absorption of a distance when the breechblock wedge is no longer movable but the control part, for attainment of a desired position of a lever, is moved still further, characterized in that the movement of the control part takes place by way of a breechblock lever shaft having a groove on an underside thereof and being arranged perpendicularly to the barrel direction, that the transmission of movement from the breechblock lever shaft to the control part takes place through a connecting member provided with a tenon on one side of the connecting member, that the connecting member is inserted in the groove on the underside of the breechblock lever shaft, that two bores are provided in the control part and are adapted to engage the tenon in the connecting member and arranged in the control part so that, depending upon the orientation of the connecting member in the groove on the underside of the breechblock lever shaft, a movement of the breechblock lever shaft in either the clockwise direction or in the counterclockwise direction for a right-handed or left-handed shooter, respectively, leads in each case to a desired opening movement of the breechblock wedge.

2. A break-open firearm according to claim 1, characterized in that a locking spring acts on the breechblock lever shaft via a spring stop to provide as the restoring force for moving the unilaterally deflected breechblock lever shaft into the central position.

3. A break-open firearm according to claim 2, characterized in that the locking spring is guided in a bore extending transversely to the breechblock lever shaft.

4. A break-open firearm according to claim 2 or 3, characterized in that the spring stop is supported by a stop bolt.

5. A break-open firearm according to claim 4, characterized in that the spring stop is rotatable by 180°, and the locking spring and the stop bolt are exchangeable with each other.

6. A break-open firearm according to claim 5, characterized in that the spring force bias of the locking spring can be adjusted.

7. A break-open firearm according to claim 2, characterized in that the restoring force of the locking spring is markedly greater than the inhibiting effect due to a limited breechblock wedge movement.

8. A break-open firearm according to claim 1, characterized in that the breechblock lever shaft is guided by means of a stud in the breechblock housing.

* * * * *